US009926820B2

(12) United States Patent
Quix et al.

(10) Patent No.: US 9,926,820 B2
(45) Date of Patent: Mar. 27, 2018

(54) OIL SYSTEM FOR A DIESEL ENGINE AND METHOD FOR OPERATING A DIESEL ENGINE

(71) Applicant: Ford Global Technologies, LLC, Dearborn, MI (US)

(72) Inventors: Hans Guenter Quix, Herzogenrath (DE); Brendan Patrick Carberry, Aachen (DE); Mario Balenovic, Waalre (NL)

(73) Assignee: Ford Global Technologies, LLC, Dearborn, MI (US)

( * ) Notice: Subject to any disclaimer, the term of this patent is extended or adjusted under 35 U.S.C. 154(b) by 173 days.

(21) Appl. No.: 15/136,634

(22) Filed: Apr. 22, 2016

(65) Prior Publication Data

US 2016/0312670 A1 Oct. 27, 2016

(30) Foreign Application Priority Data

Apr. 22, 2015 (DE) ..... 10 2015 207 287

(51) Int. Cl.
*F01M 11/00* (2006.01)
*F01M 1/16* (2006.01)
*F02D 41/02* (2006.01)

(52) U.S. Cl.
CPC ... *F01M 11/0004* (2013.01); *F01M 2001/165* (2013.01); *F01M 2011/0029* (2013.01);
(Continued)

(58) Field of Classification Search
CPC ..... F01M 11/0004; F01M 2001/165; F01M 11/04; F01M 11/045; F01M 11/12;
(Continued)

(56) References Cited

U.S. PATENT DOCUMENTS 3,712,420 A 1/1973 Pelizzoni et al.
5,238,085 A 8/1993 Engelmann
(Continued)

FOREIGN PATENT DOCUMENTS

DE 10245357 A1 4/2004
DE 69918193 T2 7/2005
(Continued)

*Primary Examiner* — William E Dondero
*Assistant Examiner* — Robert T Reese
(74) *Attorney, Agent, or Firm* — Julia Voutyras; McCoy Russell LLP

(57) ABSTRACT

An example oil system is provided, including at least one oil chamber forming an oil sump, an oil reservoir, which is arranged separately from the oil chamber, and at least partially arranged at the same geodetic height as the oil chamber, and at least one fluid connection which connects the oil chamber to the oil reservoir. An electric shut-off unit may block the fluid connection of the oil chamber to the oil reservoir in a blocking state and at least partially release the same in a release state. In order to extend oil changing intervals, a number of regeneration operations and an estimate of an instantaneous degree of dilution of oil present in the oil chamber, may be used for activating the electric shut-off unit to connect or block the fluidic connection between the oil chamber and the oil reservoir.

19 Claims, 8 Drawing Sheets

(52) U.S. Cl.
CPC .... *F01M 2011/0037* (2013.01); *F02D 41/029* (2013.01); *F02D 2250/11* (2013.01)

(58) Field of Classification Search
CPC .... F01M 2011/0029; F01M 2011/0037; F02D 41/026; F02D 2250/11
See application file for complete search history.

(56) References Cited

U.S. PATENT DOCUMENTS

| | | | | |
|---|---|---|---|---|
| 5,964,318 | A * | 10/1999 | Boyle | F01M 11/04 123/196 S |
| 7,356,989 | B2 | 4/2008 | Folliot et al. | |
| 2004/0079589 | A1* | 4/2004 | Schneider | F01M 9/02 184/1.5 |
| 2008/0053217 | A1* | 3/2008 | Nishio | F01M 11/12 73/291 |
| 2014/0209053 | A1 | 7/2014 | Norrick et al. | |
| 2017/0152775 | A1* | 6/2017 | Apostolides | F01M 11/045 |

FOREIGN PATENT DOCUMENTS

| | | | |
|---|---|---|---|
| DE | 102005051923 | A1 | 5/2007 |
| DE | 102005051924 | A1 | 5/2007 |
| DE | 102006058298 | A1 | 6/2008 |
| EP | 1900912 | A2 | 3/2008 |
| EP | 1694953 | B1 | 3/2009 |
| JP | H05272323 | A | 10/1993 |
| JP | 2009108689 | A | 5/2009 |
| JP | 2012137055 | A | 7/2012 |

* cited by examiner

OIL SYSTEM FOR A DIESEL ENGINE AND METHOD FOR OPERATING A DIESEL ENGINE

CROSS REFERENCE TO RELATED APPLICATION

This application claims priority to German Patent Application No. 102015207287.8, filed Apr. 22, 2015, the entire contents of which are hereby incorporated by reference for all purposes.

FIELD

The present description relates generally to methods and systems for controlling a vehicle engine.

BACKGROUND/SUMMARY

Internal combustion engines are provided with a supply of lubricating oil in order to reduce friction between moving parts of the engine. Once the lubricating oil reaches a given level of dilution or contamination (e.g., from fuel, water, soot, or other products), the engine is serviced to remove the oil from the oil sump and replace the oil with fresh oil. However, such maintenance is expensive and time-consuming. Further, if an operator continues to operate the engine with the diluted/contaminated oil, engine degradation may occur. Thus, it may be desirable to prolong the duration between oil change events.

U.S. Pat. No. 5,238,085 A discloses an oil changing system for a diesel engine, in which an oil level in an oil sump of the diesel engine is monitored and, if the oil level drops below a predetermined limit value, fresh oil, which is stored in a separate oil tank, is automatically introduced into the oil sump. In addition, after a predetermined operating time of the diesel engine or if a certain degree of soiling of the oil present in the oil sump is detected, the oil present in the oil sump and in the oil tank may be recirculated in an oil circuit comprising the oil sump, the oil tank and oil lines connecting the oil sump and the oil tank to each other, wherein an oil filter for cleaning the oil is arranged in an oil line.

JP 2012 137 055 A relates to a method for regenerating an oil present in an oil sump, according to which a degree of soiling of the oil is detected by means of sensors and fresh oil from an oil tank is supplied to the oil sump if the degree of soiling of the oil exceeds a predetermined limit value.

However, the inventors herein have recognized issues with the above approaches. The use of a separate oil tank may add cost and complexity to the engine system. Further, approaches that rely on a predetermined operating time may not take into account variation of oil dilution that may occur during different engine operating conditions. For example, certain engine operating conditions, such as soot particle filter regenerations, may result in a higher degree of fuel being present in the oil.

A soot particle filter with which combustion gases of a diesel engine are filtered in order to reduce the particle emission of the diesel engine is customarily arranged in an exhaust tract of the diesel engine. The particles filtered out of the exhaust gas are stored in the soot particle filter. The loading of the soot particle filter with particles causes the generation of an exhaust gas counter pressure which limits the power of the diesel engine. If an exhaust emission of the diesel engine is too greatly obstructed by the exhaust gas counter-pressure, the soot particle filter has to be regenerated. For this purpose, use is made of a regeneration operation by means of which the particles stored in the soot particle filter are burned. The power of the diesel engine is not impaired by carrying out a regeneration operation.

In a regeneration operation, in particular soot particles are converted into carbon dioxide. Such a regeneration operation is carried out by an engine control device depending on an operating profile of the diesel engine. If the diesel engine is severely loaded or operated in a high power range, relatively high exhaust gas temperatures occur that may lie within the range of the particle combustion temperature to be used for the regeneration, and therefore the soot particle filter is automatically regenerated during the operation of the diesel engine. By this means, the time interval between regeneration operations to be carried out is extended, or a regeneration operation is not required. If, by contrast, the diesel engine is operated predominantly in a low power range, relatively low exhaust gas temperatures occur in which no combustion of the particles takes place. The soot particle filter will then continue to be loaded further with particles, and therefore the regeneration operations have to be carried out at relatively short intervals.

A high exhaust gas temperature is therefore required in order to carry out a regeneration operation. Various techniques are known in order to achieve this. One of said techniques is the late post-injection of the fuel, in which the fuel is injected into the cylinder of the diesel engine during the expansion of the combustion cycle. The late post-injection is associated with poor efficiency of the combustion of the fuel, as a result of which the exhaust gas temperature rises.

During the late post-injection of the fuel into the cylinder, a portion of the fuel evaporates in the cylinders instead of being burned. Some of the evaporated fuel is deposited here on the cylinder walls. The unburned fuel adhering to the cylinder walls may pass the piston rings in the direction of the crankshaft during the piston movements and thereby enter an oil sump of the crank case. By this means, the oil located there is diluted, which impairs the quality of the oil and in particular makes the lubricating action thereof worse. The occurrence of this engine oil dilution is reinforced by an admixture of biofuels. In order not to increase the wear of the diesel engine and not to impair the durability thereof, maintenance intervals at which an oil change takes place have to be reduced.

The inventors herein propose a system and method to extend oil changing intervals in a diesel engine, wherein the diesel engine has at least one soot particle filter. In one example, an oil system for a diesel engine, in particular of a motor vehicle, may include at least one oil chamber forming an oil sump, at least one oil reservoir which is arranged separately from the oil chamber, and is at least partially arranged at the same geodetic height as the oil chamber, at least one fluid connection which connects the oil chamber to the oil reservoir in a communicating manner and on which at least one electrically operable shut-off unit is arranged, wherein the shut-off unit blocks the fluid connection in a blocking state and at least partially releases the same in a release state, and at least one electronic unit which is connectable in terms of signaling to the shut-off unit and may detect a number of regeneration operations carried out for regenerating the soot particle filter, for estimating an instantaneous degree of dilution of an oil present in the oil chamber taking into consideration the number of regeneration operations carried out and for activating the shut-off unit depending on the estimated, instantaneous degree of dilution of the oil present in the oil chamber.

In one example, an instantaneous degree of dilution of the oil present in the oil chamber may not be determined via a sensor arrangement arranged on the oil chamber, but rather estimated by means of the electronic unit taking into consideration the respective number of regeneration operations carried out for regenerating the soot particle filter. This makes a more cost-effective and lighter weight refinement of the oil system possible. If the estimated instantaneous degree of dilution of the oil present in the oil chamber is smaller than or equal to a predetermined limit value greater than zero, the shut-off unit is held in the blocking state thereof, which corresponds to a normal state of the shut-off unit which the latter takes up or maintains preferably without activation by the electronic unit. If the estimated, instantaneous degree of dilution of the oil lies above the predetermined limit value, the shut-off unit is at least temporarily transferred from the blocking state thereof into the release state thereof by means of the electronic unit. By this means, the oil which is present in the oil chamber and is diluted with diesel fuel by regeneration operations which are carried out may be mixed with oil present in the oil reservoir, as a result of which the actual degree of dilution of the oil present in the oil chamber is reduced. By this means, in comparison to an operation without thorough mixing of the oils, the oil present in the oil chamber and in the oil reservoir has to be exchanged for fresh oil only at a later time. Consequently, with the oil system, oil changing intervals are extended in the case of a diesel engine which has at least one soot particle filter.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
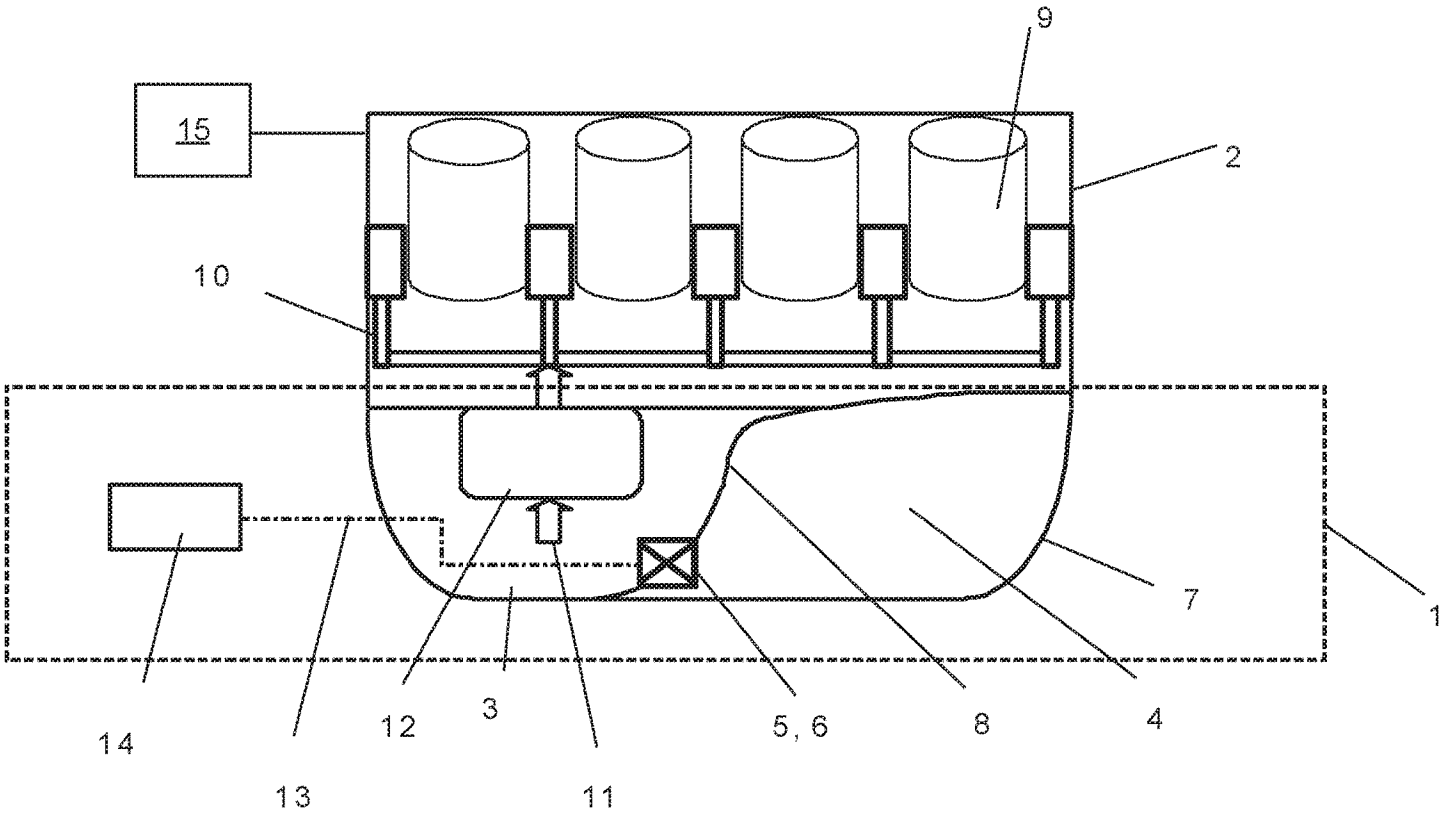
FIG. 1 shows a schematic illustration of an embodiment for an oil system of an engine.

The following description relates to systems and methods an oil system for a diesel engine, in particular of a motor vehicle. The diesel engine may include at least one soot particle filter, at least one oil chamber forming an oil sump, at least one oil reservoir which is arranged separately from the oil chamber, and is at least partially arranged at the same geodetic height as the oil chamber, at least one fluid connection which connects the oil chamber to the oil reservoir in a communicating manner and on which at least one electrically operated shut-off unit is arranged. The shut-off unit blocks the fluid connection in a blocking state and at least partially allows the fluid connection in a release state, and at least one electronic unit which is connectable in terms of signaling to the shut-off unit. Furthermore, a method for operating a diesel engine, in particular a motor vehicle, said diesel engine comprising at least one soot particle filter and at least one oil chamber forming an oil sump will be discussed below.

The shut-off unit may be adjusted responsive to an oil parameter. In one example, the oil parameter may be an oil quality, an oil dilution, and/or other factor that represents an amount of fuel that may be present in the oil in the oil sump. In some examples, the oil parameter may include a number of particulate filter regeneration events, or the oil parameter may be estimated based on the number of particulate filter regeneration events. For example, the shut-off unit may be opened responsive to an oil dilution increasing above a threshold dilution.

If the number of regeneration operations carried out for regenerating the soot particle filter is zero, there is no dilution to be reduced of the oil present in the oil chamber with diesel fuel. The electronic unit takes this into consideration and estimates therefrom the instantaneous degree of dilution of zero, which is lower than the predetermined limit value, and therefore the electronic unit does not transfer the shut-off unit into the release state thereof. If the number of regeneration operations is greater than zero, this is likewise taken into consideration by the electronic unit in the estimation of the instantaneous degree of dilution of the oil present in the oil chamber. It is possible to use an oil chamber with a lower holding volume or a lower oil volume in comparison to conventional oil sumps.

A lower oil volume is associated firstly with a shorter heating-up phase of the diesel engine. Secondly, in the event of a smaller oil volume, the oil dilution more rapidly assumes higher values. It has been shown that an oil which is diluted more greatly with diesel fuel recovers more rapidly than an oil which is comparatively less strongly diluted with diesel fuel. This means that the degree of dilution of an oil which has a higher degree of dilution decreases more rapidly than an oil which has a comparatively lower degree of dilution. As a result, an oil of a smaller oil volume may recover more rapidly between regeneration operations than an oil of a larger oil volume. This is also associated with an extension of oil changing intervals. If, in order to extend oil changing intervals, use were made only of a larger oil volume, there would be only a relatively slow decrease in the degree of dilution of the oil or recovery of the oil for the abovementioned reason.

The oil chamber forming the oil sump may be an oil sump from which oil may be pumped for lubricating engine components of the diesel engine. In order to achieve optimum thorough mixing of the oil present in the oil chamber with the oil present in the oil reservoir without having to use additional pumping means or the like for this purpose, the oil reservoir is partially or completely arranged at the same geodetic height as the oil chamber. By this means, when the shut-off unit is in the released state thereof, oil may flow virtually automatically through the fluid connection both in the direction of the oil chamber and in the direction of the oil reservoir in order to bring about the thorough mixing of the oils. Said thorough mixing may be promoted by accelerations of the oil chamber and of the oil reservoir, as occur, for example, in a driving mode of a motor vehicle. Alternatively, there is the possibility of assisting the thorough mixing by means of mechanical or electromechanical means.

The electrically operable shut-off unit may comprise a shut-off member in the form of a shut-off valve, a shut-off flap, or the like. In addition, the shut-off unit may have an electrically operable actuation unit, for example an electric motor with or without a downstream transmission, with which the shut-off member may be actuated.

The electronic unit may be formed by engine electronics of the diesel engine, vehicle electronics of a motor vehicle or as a separate constructional unit. The electronic unit may be connected in terms of signaling to the shut-off unit by a cable or without a cable. The number of regeneration operations carried out may be detected electronically by the electronic unit via a communication connection to a device carrying out the regeneration operations. Alternatively, the electronic unit may carry out the regeneration operations itself and by this means may detect the number of regeneration operations carried out.

According to an embodiment, the oil chamber and the oil reservoir are formed by an oil sump on which at least one partition is arranged, which partition separates the oil chamber from the oil reservoir and on which the fluid connection is formed, wherein the fluid connection is arranged on a portion of the partition in the vicinity of the ground. This constitutes a highly space-saving and lightweight oil system. By arranging the fluid connection on the partition in the vicinity of the ground, the thorough mixing of the oil present in the oil chamber with the oil present in the oil reservoir is facilitated or promoted.

In a further example, the electronic unit may estimate the instantaneous degree of dilution of the oil located in the oil chamber, additionally to take into consideration a decrease in the degree of dilution of the oil in a normal operation of the diesel engine in which no regeneration operation is carried out. This additional taking into consideration of the oil recovery brought about by decreasing the degree of dilution of the oil located in the oil chamber in the estimation of the instantaneous degree of dilution of the oil makes a very precise estimation of the instantaneous degree of dilution of the oil possible. Firstly, the electronic unit may estimate, taking into consideration the regeneration operations carried out, the instantaneous degree of dilution of the oil which is the maximum provided. The estimated maximum degree of dilution of the oil can decrease over the course of recovery of the oil. The electronic unit can estimate the instantaneous degree of dilution of the oil taking into consideration the recovery speed following from the respective maximum degree of dilution of the oil.

The electronic unit may estimate the instantaneous degree of dilution of the oil located in the oil chamber, to take into consideration a temperature of the oil present in the oil chamber, a temperature of a coolant of a cooler of the diesel engine, an oil level in the oil chamber and/or an operating profile of the diesel engine. The temperature of the oil present in the oil chamber can be detected by means of a sensor arrangement connected in terms of signaling to the electronic unit. The same applies to the temperature of the coolant and the oil level in the oil chamber. Alternatively, the oil level in the oil chamber can be estimated by the electronic unit taking into consideration the operating profile of the diesel engine. In order to estimate the instantaneous degree of dilution of the oil present in the oil chamber, the electronic unit can have an online model of the oil present in the oil chamber, to which online model at least the temperature of the oil present in the oil chamber, the temperature of the coolant of the cooler of the diesel engine, the oil level in the oil chamber, the operating profile of the diesel engine and/or the number of regeneration operations carried out, if said number is not detected by the electronic unit itself, can be supplied as input variables. The online model may derive therefrom an instantaneous maximum degree of dilution of the oil present in the oil chamber and the oil recovery speed following therefrom. The online model may derive therefrom the instantaneous degree of dilution of the oil present in the oil chamber. In this connection, the online model may contain at least one characteristic curve or characteristic diagram.

The method for operating a diesel engine, in particular a motor vehicle, said diesel engine having at least one soot particle filter and at least one oil chamber forming an oil sump, includes detecting a number of regeneration operations carried out for regenerating the soot particle filter, estimating an instantaneous degree of dilution of the oil present in the oil chamber taking into consideration the number of regeneration operations carried out, and at least temporarily thoroughly mixing an oil present in the oil chamber with an oil present in an oil reservoir arranged separately from the oil chamber if the estimated instantaneous degree of dilution of the oil exceeds a predetermined limit value.

The advantages mentioned above with regard to the oil system are correspondingly associated with the method. In particular, the oil system may be conducive for carrying out the method.

In the estimation of the instantaneous degree of dilution of the oil located in the oil chamber, a temperature of the oil present in the oil chamber, a temperature of a coolant of a cooler of the diesel engine, an oil level in the oil chamber and/or an operating profile of the diesel engine are/is taken into consideration. In this case, the above-described online model of the oil present in the oil chamber may be used.

Figure 2:
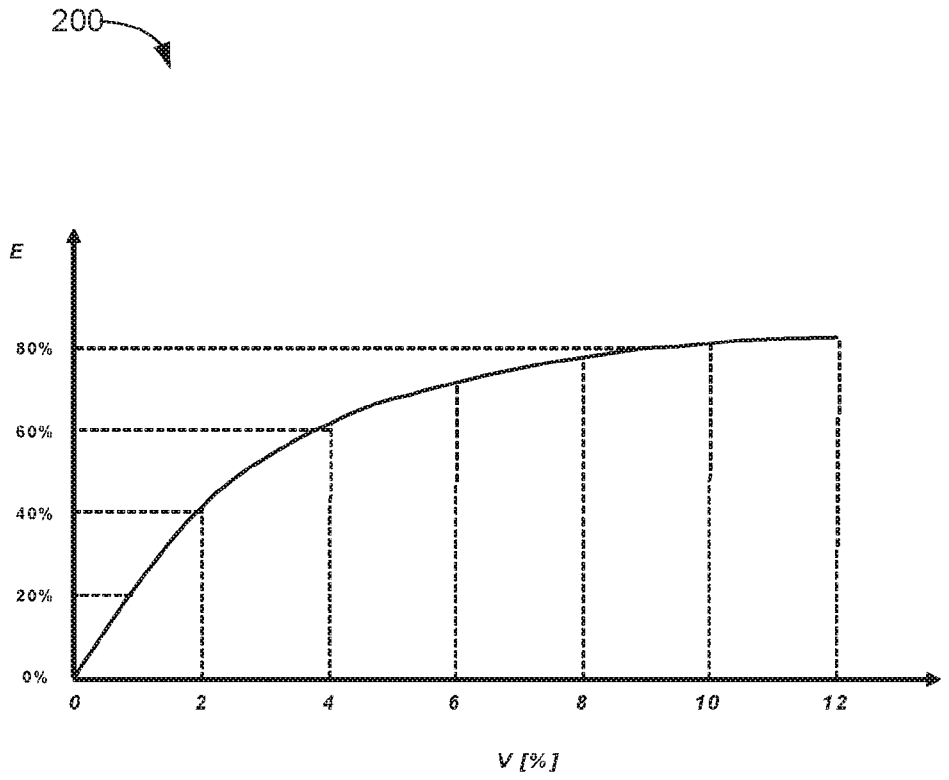
FIG. 2 shows a correlation between a percentage recovery speed of the oil and the percentage degree of dilution of the oil.
Figure 3:
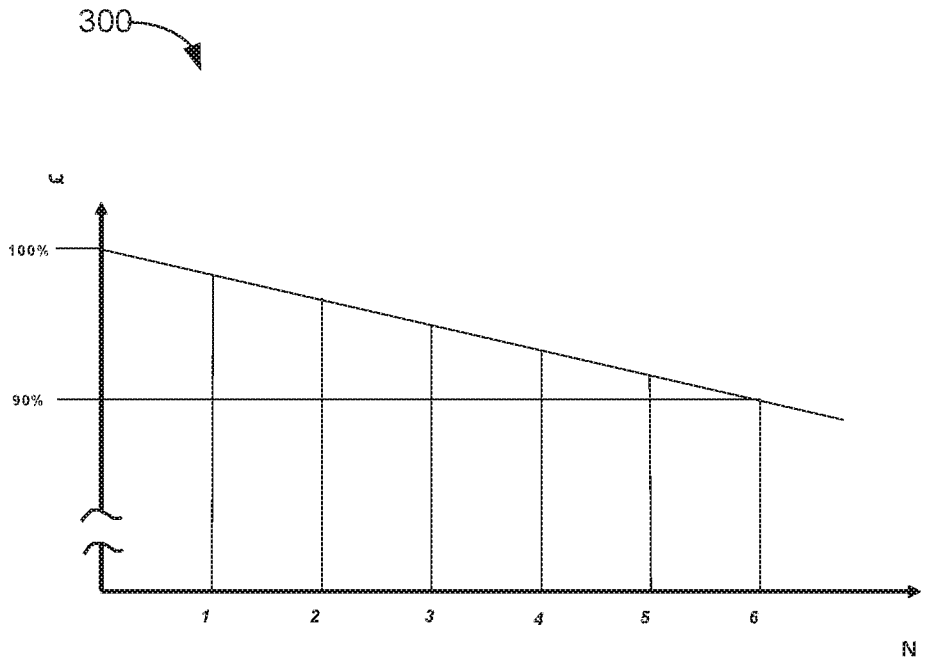
FIG. 3 shows a decrease in the quality of an oil located in a conventional oil sump, based on the number of regeneration operations carried out.
Figure 4:
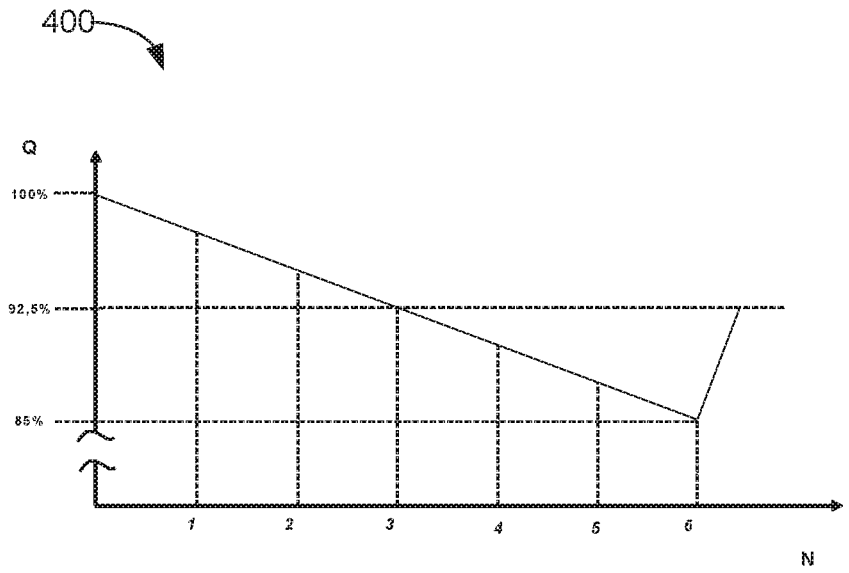
FIG. 4 shows a decrease in the quality of the oil present in the oil chamber of an oil system depending on the number of regeneration operations carried out.
Figure 5:
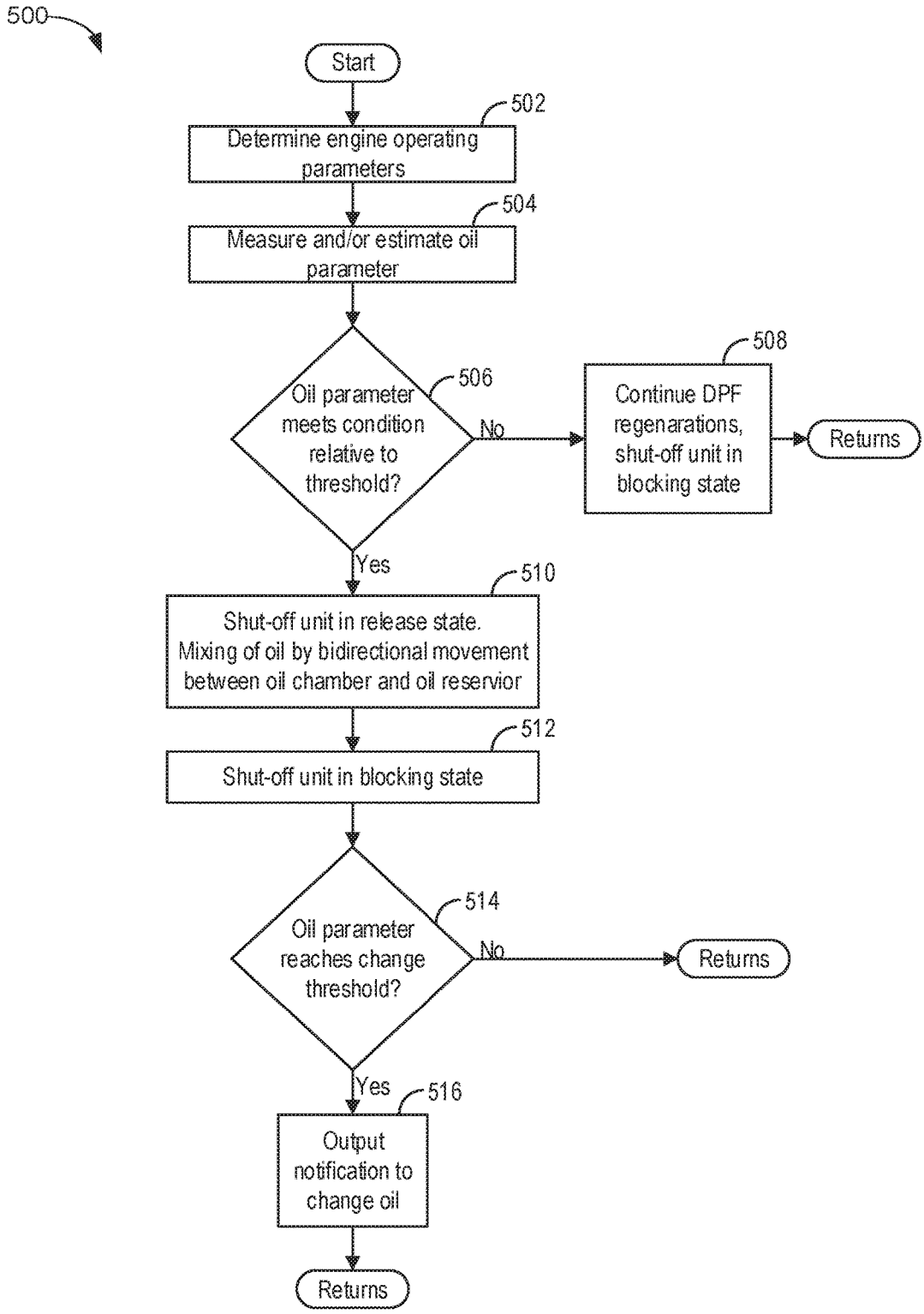
FIG. 5 shows a schematic illustration of a method for operating the oil system of FIG. 1.
Figure 6:
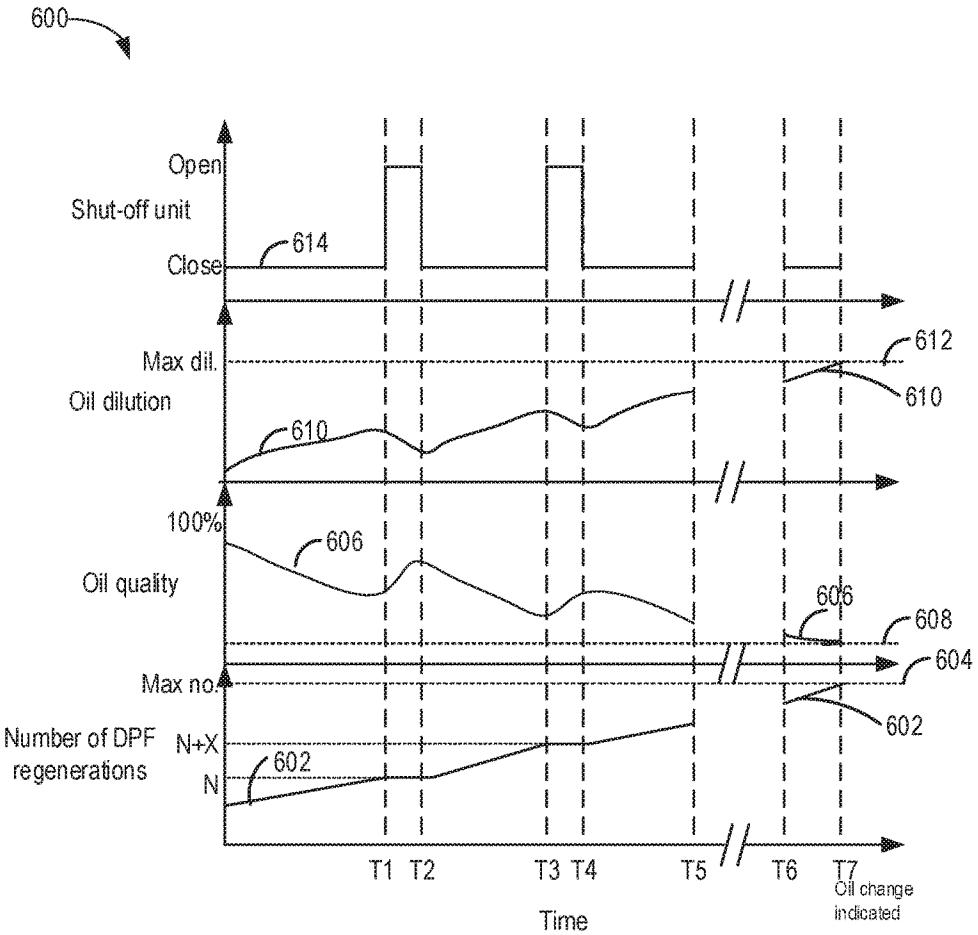
FIG. 6 shows an example plot during the operation of the oil system of FIG. 1.
Figure 7:
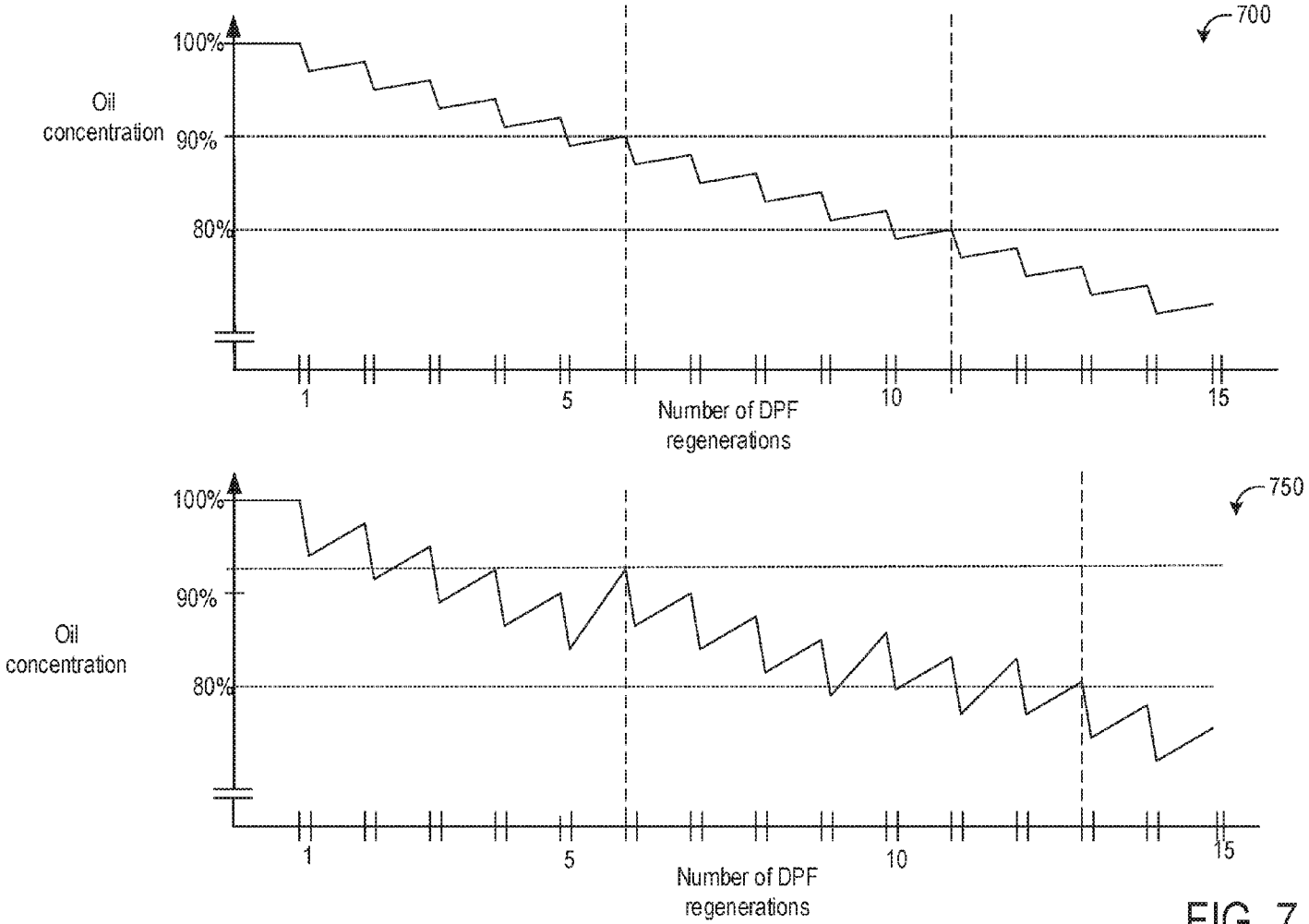
FIGS. 7 and 8 show example plots of oil concentration as a function of regeneration events.
Figure 8:
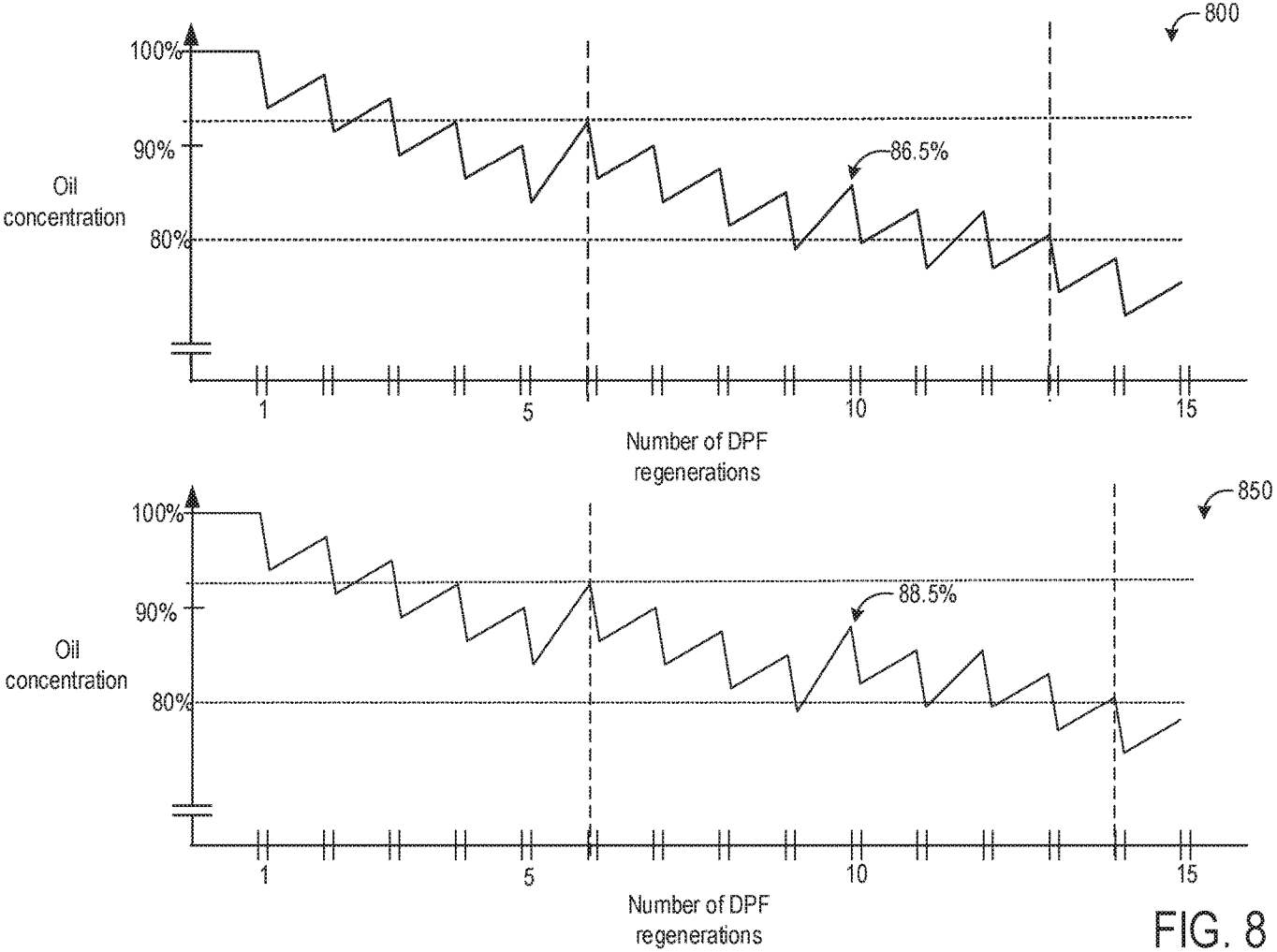

FIG. 1 shows a schematic illustration of an embodiment of an oil system and FIG. 2 shows a dependency of a percentage recovery speed of the oil on a percentage degree of dilution of the oil. FIGS. 3 and 4 show correlation of oil quality located in a conventional oil sump to the number of regeneration operations carried out. FIG. 5 shows a method for operating a diesel engine with an oil system, similar to the oil system illustrated in FIG. 1. FIG. 6 shows an example plot during the operation of the oil system of FIG. 1. FIGS. 7-8 show example plots of oil concentration as a function of regeneration events.

FIG. 1 shows example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. Yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

FIG. 1 shows a schematic of an oil system 1 for an engine, such as a diesel engine 2 of a motor vehicle, the diesel engine having at least one soot particle filter 15. The oil system 1 may include an oil chamber 3 forming an oil sump and an oil reservoir 4 which is arranged separately from the oil chamber 3 and is arranged at the same geodetic height as the oil chamber 3. Furthermore, the oil system 1 includes a fluid connection 5 which connects the oil chamber 3 to the oil reservoir 4 in a communicating manner and on which at least one electrically operable shut-off unit 6 is arranged, which shut-off unit blocks the fluid connection 5 in a blocking state and at least partially opens same in a release state.

The oil chamber 3 and the oil reservoir 4 are formed by an oil sump 7 on which a partition 8 may be arranged. The partition 8 may separate the oil chamber 3 from the oil reservoir 4 and on which the fluid connection 5 may be formed, wherein the fluid connection 5 may be arranged on a portion of the partition 8 in the vicinity of the ground. As used herein, "in the vicinity of the ground" may refer to a portion of the partition that is at or adjacent to a bottom-most surface of the oil chamber and oil reservoir (e.g., surface of the oil chamber and oil reservoir that is closest to a ground on which the vehicle rests).

The diesel engine 2 may include four cylinders 9 and an oil gallery 10, wherein the oil gallery 10 may be supplied with oil via a pump 12 corresponding to arrows 11, the oil being pumped out of the oil chamber 3 in order to lubricate components of the diesel engine.

The oil system 1 may further include an electronic unit 14 which may be connectable in terms of signaling to the shut-off unit 6 via a signal connection 13. The electronic unit 14 may detect a number of regeneration operations carried out for regenerating the soot particle filter, estimate an instantaneous degree of dilution of the oil present in the oil chamber 3 taking into consideration the number of regeneration operations carried out, and may activate the shut-off unit 6 depending on the estimated, instantaneous degree of dilution of the oil present in the oil chamber 3, as will be described below in a method with reference to FIG. 5.

Furthermore, the electronic unit 14 may estimate the instantaneous degree of dilution of the oil located in the oil chamber 3, additionally for taking into consideration a decrease in the degree of dilution of the oil in a normal operation of the diesel engine 2, in which no regeneration operation is carried out.

FIG. 2 shows a graph 200 with the dependency of a percentage recovery speed E of the oil on the percentage degree of dilution V of the oil. As used herein, "percentage recovery speed" of the oil refers to a relative amount of fuel or other diluents in the oil that may evaporate out or otherwise be removed from the oil over a given duration. For example, a 40% recovery speed may include 40% of the fuel diluting the oil evaporating out of the oil during a duration, such as during a current engine operating period, multiple engine operating periods, the lifetime of the oil in the oil sump, or other suitable duration. It may be seen that a higher degree of dilution V of the oil is associated with a higher recovery speed E of the oil. For example, the higher concentration of fuel in the oil (e.g., 4% versus 2%) may promote evaporation of the fuel due to less admixing between the fuel and oil. The electronic unit 14 may take into consideration the respective recovery speed E in the estimation of the instantaneous degree of dilution of the oil in a normal operation of the diesel engine 2.

FIG. 3 shows the decrease in a quality Q of an oil located in a conventional oil sump with a greater holding volume, wherein the decrease in the quality Q is brought about by dilution with diesel fuel, depending on a number N of regeneration operations carried out, as shown in graph 300. At the beginning, the oil quality is at 100% (e.g., no fuel is present in the oil). After six regeneration operations are carried out, the oil quality is only at 90% (e.g., 10% of the total volume of the fluid in the oil sump is comprised of fuel). In typical diesel engine systems, the average percentage degree of dilution V of the oil may be approximately 2%. The percentage recovery speed E is therefore at approximately 40%, as may be inferred from FIG. 2.

FIG. 4 illustrates a graph 400 showing the decrease in the quality Q of the oil present in the oil chamber 3, where the decrease is brought about by dilution with diesel fuel, depending on the number N of regeneration operations carried out. At the beginning, the oil quality is at 100%. Owing to a smaller oil volume that collects fuel relative to that used in comparison to FIG. 3, the percentage degree of dilution V of the oil may be at approximately 4% (e.g., double that of FIG. 3 due to the oil volume being half as the conventional sump of FIG. 3). As a result of the higher dilution, the percentage recovery speed E is therefore at approximately 60%, as illustrated in FIG. 2. Due to the higher recovery rate, the oil quality is only at 85% after six regeneration operations have been carried out, which is less than would be expected if the recovery rates were the same between FIGS. 3 and 4.

After the sixth regeneration operation or at an oil quality of 85%, the shut-off unit 6 is transferred into the release state thereof by the electronic unit 14, and therefore the oil present in the oil chamber 3 mixes with the oil present in the oil reservoir 4. Under the assumption that the oil volume in the oil chamber 3 and in the oil reservoir 4 are equal in size, the oil quality is thereby increased to 92.5% and, as a result, is higher than in the case of the conventional oil sump according to FIG. 3. By this means, an oil changing interval is extended.

The electronic unit 14 may take into consideration a temperature $T_{Oil}$ of the oil present in the oil chamber 3, a temperature $T_K$ of a coolant of a cooler (not shown) of the diesel engine 2, an oil level $S_{Oil}$ in the oil chamber 3 and/or an operating profile P of the diesel engine 2 in the estimation of the instantaneous degree of dilution of the oil located in the oil chamber 3. In one example, the operating profile may include historical engine speed and load, peak speed and load, or other suitable operating parameters.

FIG. 5 schematically shows a method 500 for operating an engine, for example the diesel engine 2. The method 500 may be carried out with the oil system 1 illustrated in FIG. 1.

Method 500 may be executed by a controller such as the electronic unit 14 of FIG. 1, based on instructions stored on a memory of the controller and in conjunction with signals received from sensors of the engine system. The controller may employ engine actuators of the engine system to adjust engine operation and may receive input from the engine and estimate oil dilution and/or oil quality based on the input parameters. The electronic unit may determine the oil dilution and/or oil quality using an online model and may regulate the position of the shut-off unit 6 based on the estimation parameters, as will be discussed below. In some examples, the controller executing method 500 may be separate from but in communication with the electronic unit 14 of FIG. 1, while in other examples, electronic unit 14 may solely execute method 500.

The method 500 begins at 502, where engine operating parameters may be determined, including but not limited to, engine speed, engine load, engine oil temperature, engine oil level, DPF regeneration status, coolant temperature etc. At 504, method 500 includes measuring and/or estimating an oil parameter. The oil parameter may include measured oil quality or oil dilution as determined from an oil quality sensor in one example. In other examples, an instantaneous oil quality or dilution may be estimated based on various input parameters. The input parameters may include temperature $T_{Oil}$ of the oil present in the oil chamber, temperature $T_K$ of the coolant of the cooler of the engine 2, an estimated oil level $S_{Oil}$ in the oil chamber 3, and an operating profile P of the engine. In addition, the number of particulate filter regeneration operations carried out may be used to determine the oil quality or dilution. As used herein, oil dilution may be the inverse of the oil quality (e.g., an oil quality of 100% may be equivalent to an oil dilution of 0%), and hence oil quality and oil dilution may be different representations of the same parameter (e.g., the amount of fuel in the oil). In one example, a particulate filter regeneration may be indicated based on exhaust pressure, soot load as determined by a soot sensor, duration since a previous regeneration event, or other suitable parameters. When the control unit commands an initiation of a regeneration event, rich and/or post-injection engine operation may commence and a counter of regeneration events stored in memory of the control unit may increment.

Based on the input parameters, the electronic unit derives an instantaneous maximum degree of dilution of the oil, e.g., the highest dilution of the oil (in the portion of the oil sump exposed to the oil from the engine) during the given operating period, which may include a duration starting from conclusion of the previous regeneration event. Furthermore, the electronic unit derives a recovery speed of the oil and an associated recovery of the oil from the input variables. For example, based on the instantaneous maximum degree of dilution, a recovery speed may be determined using a look-up table or map, such as the graph of FIG. 2. The recovery may be determined based on the recovery speed and elapsed time since initiation of the current operating period (e.g., since the conclusion of the previous regeneration event). The electronic unit derives the instantaneous degree of dilution of the oil from the maximum instantaneous degree of dilution of the oil and from the recovery of the oil.

In other words, once a current regeneration event ends (e.g., the engine resumes standard lean operation), a maximum oil dilution may be estimated based on various input parameters, including a previous number of regeneration events, oil temperature, etc. Then, based on this maximum oil dilution, a recovery rate may be determined from a look-up table, for example. As the engine continues to operate, the actual oil dilution may be calculated as a function of the maximum oil dilution, recovery rate, and time since the previous regeneration event ended.

At 506, method 500 determines if the oil parameter meets a condition relative to a threshold. In one example, where the oil parameter is a number of regeneration events, the oil parameter meeting a condition relative to a threshold may include the number of regeneration events exceeding a threshold number. In another example, where the oil parameter is oil dilution, the oil parameter meeting a condition relative to a threshold may include the oil dilution being greater than a threshold dilution, where 0% oil dilution indicates no dilution (e.g., no fuel in the oil).

If no, the method 500 proceeds to 508, continuing with subsequent DPF regenerations. The shut-off unit during the DPF regenerations is in a blocking state with no mixing of oil between the oil chamber and the oil reservoir. If the oil parameter does not meet the condition relative to the threshold, the method proceeds to 510. At 510, the shut-off unit is adjusted to be in a release state, resulting in fluidic communication between the oil chamber and the oil reservoir, allowing mixing of the oil between the oil chamber and the oil reservoir to enhance the quality of oil. The mixing of the oil may be bidirectional, including the oil moving from the oil chamber to the oil reservoir and from the oil reservoir to the oil chamber to bring about the thorough mixing of the oils. The thorough mixing may be promoted by accelerations of the oil chamber and of the oil reservoir, as occur, for example, in a driving mode of a motor vehicle. Alternatively, there is the possibility of assisting the thorough mixing by means of mechanical or electromechanical means. The method 500 proceeds to 512, where the shut-off unit goes back to blocking state, ending the fluidic communication between the oil chamber and the oil reservoir. In one example, the shut-off unit may go back to blocking state when oil quality in the oil chamber is above the threshold quality and/or when the oil dilution in the oil chamber is above the threshold dilution. In another example, the shut-off unit may go to the blocking state after being in the release state for a predefined period of time.

The method 500 proceeds to 514 to determine if the oil parameter reaches a change threshold, after which oil change may be recommended. If yes, the method proceeds to 516, where an oil change indication is conveyed to an operator, for example, though a display on a vehicle. The method 500 then returns. If the change threshold is not reached at 514, the method returns, as no oil change is indicated Thus, based on oil quality or oil dilution estimation, which may include a number of DPF regeneration cycles, the shut-off unit between the oil chamber and the oil reservoir may be regulated to enable or disable mixing of oil between the oil chamber and the oil reservoir.

In this way, a valve fluidically connecting the oil chamber and the oil reservoir (e.g., the shut-off unit) may be regulated for mixing the oil based on oil dilution as estimated based on number of regeneration of a soot particle filter. In doing so, the oil recovery rate may be increased and oil changing intervals in an engine may be extended.

FIG. 6 illustrates an example plot 600 showing a routine for oil mixing between an oil chamber and an oil reservoir by regulating opening and closing of a shut-off unit during DPF regeneration operations. In one example, the shut-off unit 6 between the oil chamber 3 and the oil reservoir 4 of FIG. 1 may be opened and closed based on number of DPF regenerations and based on oil dilution and oil quality. The horizontal axis (X axis) denotes time and the vertical markers T1-T7 identify times of interest during the oil mixing process.

A first plot line 602 shows the number of DPF regenerations. The maximum number of DPF regenerations possible before oil change is indicated is denoted by a line 604. A second plot line 606 shows oil quality in the oil chamber and a line 608 indicates a lower threshold for oil quality, below which oil change is recommended. The third plot line 610 shows an oil dilution percentage, with a line 612 indicating the upper threshold for oil dilution, after which oil change is recommended. The oil may be diluted with engine fuel, which may in turn diminish oil quality. The fourth plot line 614 shows a position (closed or open) of the shut-off unit between the oil chamber and the oil reservoir.

Prior to T1, N number of DPF regenerations may be carried out as indicated by the first plot line 602. With the increasing number of DPF regenerations, oil quality (the second plot line 606) keeps decreasing and the oil dilution (the third plot line 610) keeps increasing, while the shut-off unit remains closed (the fourth plot line 614). N may be a predetermined number, for example, N may be equal to six, where six DPF regeneration operations may be carried out.

After N number of DPF regenerations, the shut-off unit between the oil chamber and the oil reservoir is opened at time T1, as indicated by the fourth plot line 614. At T1, oil between the oil chamber and the oil reservoir may mix by bidirectional movement of oil between the oil chamber and the oil reservoir. The shut-off unit may remain open from T1-T2, followed by closing of the shut-off unit at T2. During T1-T2, mixing of oil between the oil chamber and the oil reservoir through the shut-off unit may enhance oil quality and decrease oil dilution as indicated by the second plot line 606 and the third plot line 610, respectively. The DPF regeneration may remain suspended during T1-T2 as indicated by the first plot line 602.

After closing of the shut-off unit, the DPF regeneration may resume at T2 and continue through the time T2-T3, wherein the shut-off unit may be closed from T2-T3, the oil dilution may increase and the oil quality may decrease during T2-T3, as no oil mixing happens between the oil chamber and the oil reservoir.

At T3, the number of DPF regenerations may reach N+X regenerations. In one example, N and X may be equal numerical values. In other examples, X may be more than or less than N. At T3, when the number of DPF regenerations reaches N+X, the shut-off unit is opened to allow mixing of oil during the time T3-T4. Mixing of oil between T3-T4, decreases oil dilution (plot line 610) and increases oil quality (plot line 606). At T4, the shut-off unit is closed and returns to blocking state, where no more oil mixing takes place. DPF regenerations may be suspended during T3-T4, and may resume at T4. In one example, T1-T2 may be equal to T3-T4. In other examples, T1-T2 may be less than or more than T3-T4.

During T4-T5, the shut-off unit may be closed and the DPF regenerations may continue, along with an increase in oil dilution (plot line 610) and decrease in oil quality (plot line 606).

Between T6-T7, the number of DPF regenerations may approach a maximum number of regenerations and reach the maximum number of regenerations at T7. At T7, the oil quality may reach the lower threshold for oil quality 608 and the oil dilution may reach the upper dilution limit 612. In one example, the oil quality and the oil dilution may reach the lower oil quality threshold and the maximum dilution limit after T7. The shut-off unit during T6-T7 remains closed. At T7, upon reaching the maximum regeneration number threshold, an indication for oil change may be conveyed to the operator, for example, through a display on the vehicle recommending oil change. In other examples, oil change may be indicated upon the oil quality reaching the lower threshold and/or the oil dilution reaching the upper threshold.

Referring now to FIG. 7, example plots of oil concentration as a function of DPF regeneration events are depicted. Plot 700 shows oil concentration as a function of DPF events for an oil sump with single oil chamber and hence no mixing. Plot 750 shows oil concentration as a function of DPF events for oil in an oil chamber of an oil sump with an associated reservoir that is configured to undergo mixing, such as the oil sump of FIG. 1.

For each of plot 700 and 750, oil concentration starts at 100% due to no regeneration events having yet occurred. When the first regeneration event occurs, the oil concentration decreases due to excess fuel injection to initiate the regeneration. For plot 700 with a single, larger oil chamber, the concentration decreases by a first, smaller amount. For plot 750 with the dual, smaller oil chamber and oil reservoir, the oil concentration in the oil chamber decreases by a second, larger amount. After regeneration ceases, the oil recovers (e.g., some of the fuel evaporates) and the oil concentration increases up until the next regeneration occurs. For plot 700, the recovery rate is less than for plot 750 due to the larger volume of oil and hence smaller concentration of fuel.

The process of oil concentration decrease during regeneration followed by a recovery period after regeneration repeats for each subsequent regeneration. During the fifth regeneration event shown on plot 700, the oil concentration drops below 90% and does not recover back above 90%. However, as illustrated in plot 750, the oil concentration drops below 90% during the third regeneration event, due to the higher fuel concentration in the oil of the smaller volume chamber.

After the fifth regeneration event, the system that includes the dual chamber-reservoir sump has oil concentration of 85%, which triggers initiation of a mixing event, where the shut-off element is opened to allow mixing of the two volumes of oil (e.g., oil in the oil reservoir, which is at 100% oil concentration, mixes with the oil in the chamber). After mixing (e.g., the start of the sixth regeneration event), the oil concentration is at 92.5%. In contrast, for the single-volume sump, at the sixth regeneration event, the oil concentration is at 90%. Thus, as a result of the increased recovery rate of the dual chamber-reservoir sump, the oil concentration is higher than the single-volume sump, even though the total volume for both sumps is equal.

In the example illustrated in FIG. 7, an oil change may be triggered when the oil concentration drops and stays below 80%. Thus, for the single-volume sump, an oil change notification is issued at the eleventh regeneration event. For the dual-volume sump, however, another round of mixing occurred at the ninth regeneration event, boosting the oil concentration and prolonging operation at oil concentrations above the oil change threshold. Thus, an oil change in not indicated for the two-volume sump until the thirteenth regeneration, thus allowing an additional two regeneration events.

It is to be understood that the oil concentrations depicted in FIG. 7 are merely exemplary, and other concentrations are possible. Further, for each of plots 700 and 750, the recovery rate is illustrated as remaining constant, despite increasing fuel concentration in the respective oil sumps. As such, in some examples, the recovery rate for each plot may increase as fuel concentration increases.

In some examples, when the oil in the two volumes mixes and the oil in the reservoir includes a volume of fuel, the fuel may evaporate out of the reservoir. For example, fuel vapors may collect in a vapor space of the reservoir and be directed to the engine for combustion. As such, the mixing that occurs after the first round of mixing may result in even higher oil concentration than shown by plot 750 of FIG. 7.

FIG. 8 shows example plots of oil concentration as a function of DPF regeneration events. Plot 800 shows oil concentration as a function of DPF events for oil in an oil chamber of an oil sump with an associated reservoir that is configured to undergo mixing, such as the oil sump of FIG. 1, where the reservoir is pressurized or otherwise does not allow for substantial fuel evaporation out of the reservoir. Plot 800 is identical to plot 750 of FIG. 7. Plot 850 shows oil concentration as a function of DPF events for oil in an oil chamber of an oil sump with an associated reservoir that is configured to undergo mixing, such as the oil sump of FIG. 1, where the reservoir does allow for fuel evaporation out of the reservoir.

Prior to the second mixing event at regeneration nine, both plots 800 and 850 are identical. However, at the second mixing event, the oil concentration as shown in plot 850 is higher than that of plot 800, for example 88.5% versus 86.5%. This is because some of the fuel evaporated out of the oil in reservoir of the oil sump. As such, the oil change threshold is not reached until the fourteenth regeneration event.

The technical effect of regulating oil mixing based on frequency of soot particle filter regeneration and based on oil quality and oil dilution, is an increase in oil recovery, which extends oil changing intervals, resulting in efficient use of oil for a longer period of time and decreasing costs.

An example engine, including at least one soot particle filter, has at least one oil chamber forming an oil sump, at least one oil reservoir arranged separately from the oil chamber, the at least one oil reservoir at least partially arranged at the same geodetic height as the oil chamber, at least one fluid connection fluidically connecting the oil chamber to the oil reservoir, at least one electrically operable shut-off unit between the oil chamber and the oil reservoir, the at least one electrically operable shut-off unit blocking the at least one fluidic connection between the oil chamber and the oil reservoir in a blocking state and at least partially enabling fluidic connection between the oil chamber and the oil reservoir in a release state, and at least one electronic unit connected to the electrically operable shut-off unit regulating the blocking state and the release state based on a number of regeneration operations of the at least one soot particle filter and on a degree of dilution of an oil present in the oil chamber. A first example of the engine includes, wherein at least one partition is arranged between the oil chamber and the oil reservoir, the at least one partition separating the oil chamber from the oil reservoir and the at least one fluid connection is formed on the at least one partition. A second example of the system optionally includes the first example and further includes, wherein the at least one fluid connection is arranged on a portion of the partition in a vicinity towards ground. A third example of the system optionally includes one or more of the first and second examples, and further includes wherein the blocking state is seen when the electronic unit estimates a degree of dilution of the oil in the oil chamber below a threshold dilution. A fourth example of the system optionally includes one or more of the first through the third examples, and further includes wherein the release state is seen when the electronic unit estimates the degree of dilution of the oil in the oil chamber above the threshold dilution. A fifth example of the system optionally includes one or more of the first through the fourth examples, and further includes wherein a quality of the oil in the oil chamber is estimated by the electronic control unit, the quality of the oil above a threshold quality results in the blocking state and the quality of the oil below the threshold quality results in the release state. A sixth example of the system optionally includes one or more of the first through the fifth examples, and further includes wherein the electronic unit is configured to receive inputs conveying a temperature of the oil present in the oil chamber, a temperature of a coolant of a cooler of the engine, an oil level in the oil chamber and an operating profile of the engine.

Another example of an engine, including at least one soot particle filter with at least one oil chamber, at least one oil reservoir at least partially arranged at the same geodetic height as the oil chamber, at least one shut-off unit between the oil chamber and the oil reservoir, and at least one electronic unit connected to the shut-off unit. A second example of the system optionally includes the first example and further includes, wherein the electronic unit opens the at least one shut-off element responsive to a quality of an oil in the oil chamber being below a threshold quality, enabling mixing of the oil between the oil chamber and the oil reservoir. A third example of the system optionally includes one or more of the first and second examples, and further includes wherein the electronic unit closes the at least one shut-off element responsive to the quality of the oil in the oil chamber being above the threshold quality, blocking enabling mixing of the oil between the oil chamber and the oil reservoir. A fourth example of the system optionally includes one or more of the first through the third examples, and further includes wherein the electronic unit is configured to estimate the quality of the oil based on a number of regeneration operations of the at least one soot particle filter. A fifth example of the system optionally includes one or more of the first through the fourth examples, and further includes wherein the oil chamber includes an oil sump. A sixth example of the system optionally includes one or more of the first through the fifth examples, and further includes wherein the at least one shut-off element is present towards a bottom of a partition wall separating the oil chamber and the oil reservoir.

An example method, comprising detecting a number of regeneration operations carried out for regenerating a soot particle filter, estimating an instantaneous degree of dilution of an oil present in an oil chamber based on number of regeneration operations carried out, and at least temporarily thoroughly mixing the oil present in the oil chamber with an oil present in an oil reservoir, the oil reservoir fluidically connected through a shut-off element to the oil chamber, wherein the estimated instantaneous degree of dilution of the oil exceeds a threshold dilution. A first example of the method, wherein a controller receives input parameters for estimating the instantaneous degree of dilution. A second example of the method optionally includes the first example and further includes estimating the instantaneous degree of dilution of the oil by the controller based on the input parameters, including a temperature of the oil present in the oil chamber, a temperature of a coolant of a cooler of the engine, an oil level in the oil chamber, and on an operating profile of the engine. A third example of the method optionally includes the first through the second examples, and further includes closing the shut-off element by the controller responsive to the instantaneous degree of dilution of the oil being less than the threshold dilution. A fourth example of the method optionally includes the first through the third examples, and further comprising opening the shut-off element by the controller responsive to the instantaneous degree of dilution of the oil being more than the threshold dilution. A fifth example of the method optionally includes the first through the fourth examples, and further comprising estimating a quality of oil by the controller, and responsive to the quality of oil being above a threshold quality, closing the shut-off element and responsive to the quality of oil being less than the threshold quality, opening the shut-off element.

In another example, a method for operating an oil system of an engine comprises adjusting a shut-off unit via an actuator between an oil chamber and an oil reservoir based on a number of particulate filter regenerations and a degree of oil dilution in the oil chamber. Depending on a combination of the oil dilution (e.g., estimated by a controller based on various operating conditions) and the number of regenerations (e.g., counted by the controller and incremented after each complete filter regeneration, but not incremented for partial regenerations), the mixing of oil is carried out in order to prolong the oil quality for a greater total number of regeneration before indicating an oil change is requested and/or required via a display to an operator.

In a first example of the method, adjusting the shut-off unit based on the number of particulate filter regenerations and the degree of oil dilution in the oil chamber comprises: determining a maximum oil dilution based on the number of particulate filter regenerations; determining a recovery rate of the oil in the oil chamber based on the maximum oil dilution; and determining the degree of oil dilution in the oil chamber based on the maximum oil dilution and recovery rate. A second example optionally includes the first example and further includes wherein adjusting the shut-off unit comprises opening the shut-off unit to allow fluidic communication between the oil chamber and the oil reservoir responsive to the degree of oil dilution in the oil chamber exceeding a threshold dilution. A third example optionally includes one or both of the first and second examples and further includes indicating an oil change based on the number of particulate filter regenerations reaching a maximum regeneration number. A fourth example optionally includes one or each of the first through third examples and further includes suspending particulate filter regeneration at opening of the shut-off unit and resuming particulate filter regeneration at closing of the shut-off unit. A fifth example optionally includes one or each of the first through fourth examples and further includes estimating the degree of oil dilution in the oil chamber based on the input parameters, including a temperature of the oil present in the oil chamber, a temperature of a coolant of a cooler of the engine, an oil level in the oil chamber, and on an operating profile of the engine.

An embodiment of a system includes a soot particle filter; an oil chamber; an oil reservoir at least partially arranged at the same geodetic height as the oil chamber; a shut-off unit between the oil chamber and the oil reservoir; and an electronic control unit connected to the shut-off unit, the electronic control unit including instructions executable to adjust a position of the shut-off unit based on a number of regeneration events of the soot particle filter and further based on an oil recovery rate.

In a first example of the system, the electronic control unit includes instructions executable to estimate a quality of the oil based on the number of regeneration events and the oil recovery rate. A second example optionally includes the first example and further includes wherein the electronic control unit includes instructions executable to open the shut-off unit responsive to the quality of an oil in the oil chamber being below a threshold quality, enabling mixing of the oil between the oil chamber and the oil reservoir. A third example optionally includes one or both of the first and second examples and further includes wherein the electronic control unit includes instructions executable to close the at least one shut-off unit responsive to the quality of the oil in the oil chamber being above the threshold quality, blocking mixing of the oil between the oil chamber and the oil reservoir. In an example, the shut-off element is a flap valve.

Another example method for operating an oil system of the engine comprises, opening a shut-off unit via an actuator between an oil chamber and an oil reservoir based on a number of particulate filter regenerations reaching a threshold number and a degree of oil dilution in the oil chamber reaching a dilution threshold, bidirectional mixing of oil between the oil chamber and the oil reservoir through the shut-off unit, and suspending bidirectional mixing by closing the shut-off unit via the actuator. The method may further comprise, indicating an oil change based on the number of particulate filter regenerations reaching a maximum regeneration number. In one example, the particulate filter regeneration may be suspended during the opening of the shut-off unit and resumed upon closing of the shut-off unit.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An oil system of an engine coupled to at least one soot particle filter, comprising:

at least one oil chamber forming an oil sump;

at least one oil reservoir arranged separately from the oil chamber, the at least one oil reservoir at least partially arranged at the same geodetic height as the oil chamber;

at least one fluid connection fluidically connecting the oil chamber to the oil reservoir;

at least one electrically operable shut-off unit between the oil chamber and the oil reservoir, the at least one electrically operable shut-off unit blocking the at least one fluidic connection between the oil chamber and the oil reservoir in a blocking state and at least partially enabling fluidic connection between the oil chamber and the oil reservoir in a release state; and at least one electronic unit connected to the electrically operable shut-off unit regulating the blocking state and the release state based on a number of regeneration operations of the at least one soot particle filter and based on a degree of dilution of an oil present in the oil chamber.

2. The oil system of claim 1, wherein at least one partition is arranged between the oil chamber and the oil reservoir, the at least one partition separating the oil chamber from the oil reservoir and the at least one fluid connection is formed on the at least one partition.

3. The oil system of claim 2, wherein the at least one fluid connection is arranged on a portion of the partition in a vicinity towards ground.

4. The oil system of claim 1, wherein the blocking state results when the electronic unit estimates a degree of dilution of the oil in the oil chamber below a threshold dilution.

5. The oil system of claim 4, wherein the release state results when the electronic unit estimates the degree of dilution of the oil in the oil chamber above the threshold dilution.

6. The oil system of claim 1, wherein a quality of the oil in the oil chamber is estimated by the electronic control unit, the quality of the oil above a threshold quality resulting in the blocking state and the quality of the oil below the threshold quality resulting in the release state.

7. The oil system of claim 1, wherein the electronic unit is configured to receive inputs conveying a temperature of the oil present in the oil chamber, a temperature of a coolant of a cooler of the engine, an oil level in the oil chamber, and an operating profile of the engine.

8. The oil system of claim 1, wherein the at least one shut-off unit is a-two way valve.

9. A method for operating an oil system of an engine comprising:

adjusting a shut-off unit via an actuator between an oil chamber and an oil reservoir based on a number of particulate filter regenerations and a degree of oil dilution in the oil chamber.

10. The method of claim 9, wherein adjusting the shut-off unit based on the number of particulate filter regenerations and the degree of oil dilution in the oil chamber comprises:

determining a maximum oil dilution based on the number of particulate filter regenerations;

determining a recovery rate of the oil in the oil chamber based on the maximum oil dilution; and determining the degree of oil dilution in the oil chamber based on the maximum oil dilution and recovery rate.

11. The method of claim 10, wherein adjusting the shut-off unit comprises opening the shut-off unit to allow fluidic communication between the oil chamber and the oil reservoir responsive to the degree of oil dilution in the oil chamber exceeding a threshold dilution.

12. The method of claim 9, further comprising indicating an oil change based on the number of particulate filter regenerations reaching a maximum regeneration number.

13. The method of claim 9, further comprising suspending particulate filter regeneration at opening of the shut-off unit and resuming particulate filter regeneration at closing of the shut-off unit.

14. The method of claim 9, further comprising estimating the degree of oil dilution in the oil chamber based on the input parameters, including a temperature of the oil present in the oil chamber, a temperature of a coolant of a cooler of the engine, an oil level in the oil chamber, and on an operating profile of the engine.

15. A system, comprising:

a soot particle filter;

an oil chamber;

an oil reservoir at least partially arranged at the same geodetic height as the oil chamber;

a shut-off unit between the oil chamber and the oil reservoir; and an electronic control unit connected to the shut-off unit, the electronic control unit including instructions executable to adjust a position of the shut-off unit based on a number of regeneration events of the soot particle filter and further based on an oil recovery rate.

16. The system of claim 15, wherein the electronic control unit includes instructions executable to estimate a quality of the oil based on the number of regeneration events and the oil recovery rate.

17. The system of claim 16, wherein the electronic control unit includes instructions executable to open the shut-off unit responsive to the quality of an oil in the oil chamber being below a threshold quality, enabling mixing of the oil between the oil chamber and the oil reservoir.

18. The system of claim 16, wherein the electronic control unit includes instructions executable to close the shut-off unit responsive to the quality of the oil in the oil chamber being above the threshold quality, blocking mixing of the oil between the oil chamber and the oil reservoir.

19. The system of claim 15, wherein the shut-off unit is a flap valve.

* * * * *